US008251617B2

(12) United States Patent
Leppanen

(10) Patent No.: US 8,251,617 B2
(45) Date of Patent: Aug. 28, 2012

(54) ROCK ANCHOR CABLE

(75) Inventor: Jarmo Uolevi Leppanen, Johannesburg (ZA)

(73) Assignee: Sandvik Mining and Construction RSA (pty) Ltd, East Rand (ZA)

( * ) Notice: Subject to any disclaimer, the term of this patent is extended or adjusted under 35 U.S.C. 154(b) by 0 days.

(21) Appl. No.: 13/058,195

(22) PCT Filed: Aug. 5, 2009

(86) PCT No.: PCT/ZA2009/000072

§ 371 (c)(1),
(2), (4) Date: Feb. 8, 2011

(87) PCT Pub. No.: WO2010/019971

PCT Pub. Date: Feb. 18, 2010

(65) Prior Publication Data

US 2011/0135402 A1 Jun. 9, 2011

(30) Foreign Application Priority Data

Aug. 11, 2008 (ZA) ..... 2008/06884

(51) Int. Cl.
*E21D 21/00* (2006.01)

(52) U.S. Cl. ..... 405/302.2; 405/259.5; 405/259.4; 405/302.1

(58) Field of Classification Search ..... 405/259.1, 405/259.4, 302.1, 302.2, 259.5
See application file for complete search history.

(56) References Cited

U.S. PATENT DOCUMENTS

| | | | | |
|---|---|---|---|---|
| 5,511,909 | A * | 4/1996 | Calandra et al. | 405/302.2 |
| 5,525,013 | A * | 6/1996 | Seegmiller et al. | 405/302.2 |
| 5,531,545 | A * | 7/1996 | Seegmiller et al. | 405/302.2 |
| 5,586,839 | A * | 12/1996 | Gillespie | 405/302.2 |
| 5,622,454 | A * | 4/1997 | Ashmore et al. | 405/302.2 |
| 6,270,290 | B1 * | 8/2001 | Stankus et al. | 405/302.2 |
| 6,402,433 | B1 * | 6/2002 | Gillespie | 405/302.2 |
| 6,428,243 | B1 * | 8/2002 | Hutchins | 405/302.2 |
| 6,561,721 | B2 * | 5/2003 | Lausch et al. | 405/302.2 |
| 2009/0317197 | A1 * | 12/2009 | Hinton et al. | 405/302.2 |

FOREIGN PATENT DOCUMENTS

| | | |
|---|---|---|
| AU | 9889395 | * 11/1986 |
| WO | WO 8606447 A2 | * 11/1986 |

* cited by examiner

*Primary Examiner* — Frederick L Lagman

(57) ABSTRACT

A rock anchor (10) which includes a cable (12) with a hollow core, an expansion mechanism (20) at one end of the cable, a tube (14), which acts on a load washer (16), in which part of the cable is located, and a wedge (18) which locks the cable to the tube.

9 Claims, 9 Drawing Sheets

ROCK ANCHOR CABLE

BACKGROUND OF THE INVENTION

This invention relates to a ground anchor which is suitable for use in the reinforcement of rock.

As used herein "rock" includes rock strata, a cementitious body or similar hard material.

The provision of support in an underground mining excavation in a cost effective manner is of paramount importance.

Support structures such as hydraulically or mechanically extensible steel jacks, elongate wooden supports, mat packs, mechanically actuated or grouted rock bolts or cable anchors, and bags or tubes which are filled with a settable material, have all been used to provide support.

In narrower excavations mechanical ground anchors have not found widespread acceptance because of space limitations. It is difficult to drill vertical holes, up to two meters long, for steel anchors in a confined space. Reliance must be placed on extension drilling techniques with coupling rods. The installation of steel anchors is also problematic. A steel anchor should have a length which is about twice the height of the stope which is to be supported and must therefore be constructed from several short sections which are bolted together using extension sleeves at the time of installation. A polyester resin is commonly used to anchor a steel shank in a hole. The volume of resin which is needed to fill an annular space in a hole, around a bolt shank, can be high and the resin is expensive. Moreover if the quantity of resin is large then the bonding strength of the resin is effectively reduced and the steel anchor cannot carry its designed load. It is also difficult to assess the quality of the installation because the shank must be rotated, at the time of installation, to break the resin capsules and to mix the resin. Inadequate or excessive rotation adversely affects the shear strength of the resin.

A nut which is engaged with a protruding threaded end of the shank is tightened against a face plate which is engaged with the shank and which bears against the rock face. The nut and protruding end of the shank remain exposed. This is undesirable because the protruding components can severely restrict movement of men and machinery in a shallow excavation.

It is an object of the present invention to provide various components of a rock anchor which can be used alone, or in combination, to address some or all of the aforementioned problems. The invention is described hereinafter with particular reference to an anchor used in a horizontal narrow reef underground support application but this is exemplary only and is non-limiting.

SUMMARY OF INVENTION

The invention provides a rock anchor which includes an elongate, flexible element with first and second ends, an anchor expansion mechanism at the first end, a tubular barrel into which the second end extends, and a locking arrangement inside the barrel which permits movement of the element in a first direction in the barrel and which locks the element to the barrel when the element moves in a second direction, opposing the first direction, in the barrel. The elongate element is preferably formed from a plurality of helically wound wires which extend around a longitudinally extending hollow core. The hollow core may be formed in any appropriate way, for example by winding the plurality of wires around a hollow former. In a preferred embodiment the hollow core is formed by removing, from a cable, a centrally positioned core wire around which the plurality of helically wound wires extend.

At least one external sleeve or clamp may be attached to the cable. The sleeve helps to retain the helically wound wires in position, in the absence of the core wire. Preferably a plurality of sleeves are attached to the cable at spaced locations. Each sleeve is clamped to the cable using any appropriate technique.

The cable may be protected against corrosion in any appropriate way, for example by means of a corrosion coating or by encasing the cable in a protective sheath e.g. a plastic sheath which is shrink wrapped or otherwise adhered to the cable exterior.

The expansion mechanism may be of any appropriate kind and may be actuable from a contracted position to an expanded position in order to lock the cable frictionally in position in a hole in a rock face.

The hollow core may be used, in practice, as a passage for a fluid settable material such as a cementitious or resin grout or to form a path for airflow when the cable is installed.

The nature of the cable construction may be such that, once the hollow core is formed, tensioning of the cable causes the helically wound wires to move slightly inwardly, towards each other, and in this way the hollow core is effectively sealed to prevent or limit air or liquid passage from the core to a space which is external of the cable, or in the reverse direction, through gaps between the helically wound wires.

In one form of the invention the rock anchor includes a load-distributing face plate with an inner side and an outer side, at one end of the tubular barrel and a mechanism which is actuable to exert force on the inner side.

The mechanism may be a resiliently deformable, biasing component which acts against the inner side of the load-distributing face plate.

The biasing component may be of any appropriate kind and preferably is a body, of a resiliently deformable material such as rubber, with an aperture or passage through which the elongate member extends.

In a variation of the invention the mechanism is a preloading component which is expansible by the application of a pressurized fluid, for example water. The component may include a metallic housing, which encloses a volume into which water under pressure is introduced. The housing is distorted as the volume is expanded and a tensile force is thereby exerted by the housing, which acts between the elongate member and a rock face surrounding a hole in which the elongate member is inserted, on the elongate member.

The expansion mechanism may include a wedge component which has a leading end and a trailing end and which extends around the first end of the elongate element, the leading end of the wedge component extending beyond the first end of the elongate element and the wedge component being of reducing cross section towards the trailing end, a shell arrangement which has an inner cavity of complementary shape to the wedge component which is located at least partly within the inner cavity, the shell arrangement having a base which surrounds the elongate element, and stop structure on the elongate member located so that when the elongate element is moved in an axial direction, to cause the leading end of the wedge component to strike a reaction surface, the wedge component is driven into the inner cavity thereby to expand the shell arrangement.

The locking arrangement may include stop structure on the elongate element near the second end, a wedge member around the elongate element, and a biasing member which acts between the stop structure and the wedge member and which tends to displace the wedge member away from the stop structure, and wherein the wedge member are positioned inside the barrel and the second end of the elongate element located within, and not protruding from, the tubular barrel.

The tubular barrel may be shaped so that the wedge member acts against a complementary formation inside the tubular barrel.

The anchor expansion mechanism is preferably impact-actuable i.e. it is set by impacting the first end of the elongate member against a hard surface (a blind end of a hole in which the elongate element is located).

The tubular barrel may have a first, inner mouth and a second, outer mouth and a passage between the mouths through which the elongate element passes and the locking arrangement may include a wedge device, inside the passage, which is engagable with a surface of the passage of complementary taper to the wedge device.

A biasing member may act between the element and the wedge device. The biasing member may urge the wedge device towards the surface of complementary taper. This may be in the second direction.

The elongate flexible member may include a weakened zone. The weakening of the zone may be done in any appropriate way for example by reducing the cross-sectional area of the element in the zone or by heat treating or otherwise processing a portion of the element in the zone.

The zone may be between the second, outer mouth of the tubular barrel and the biasing member.

The barrel may be engaged with or be formed integrally with a face plate. The face plate may be domed.

The expansion mechanism may include an impact sleeve, with an outer wedge surface, and a passage into which the first end of the elongate element extends, and a shell arrangement which, at least partly, surrounds the wedge surface.

The invention also extends to a method of reinforcing a rock which includes the steps of forming a hole into the rock from a rock face, placing an elongate, flexible element in the hole, urging a first end of the elongate element towards a bottom of the hole thereby to actuate an anchor expansion mechanism which is engaged with the first end, applying a tensile force to the elongate element by exerting an expansion force between a portion of the elongate element, which extends from the hole, and the rock face, providing a weakened zone in the elongate element, near the rock face, which breaks when the tensile force is greater than a predetermined value and, upon breakage, actuating a locking arrangement to lock the elongate element to a face plate at the rock face.

BRIEF DESCRIPTION OF THE DRAWINGS

The invention is further described by way of example with reference to the accompanying drawings in which.

DESCRIPTION OF PREFERRED EMBODIMENTS

Figure 1:
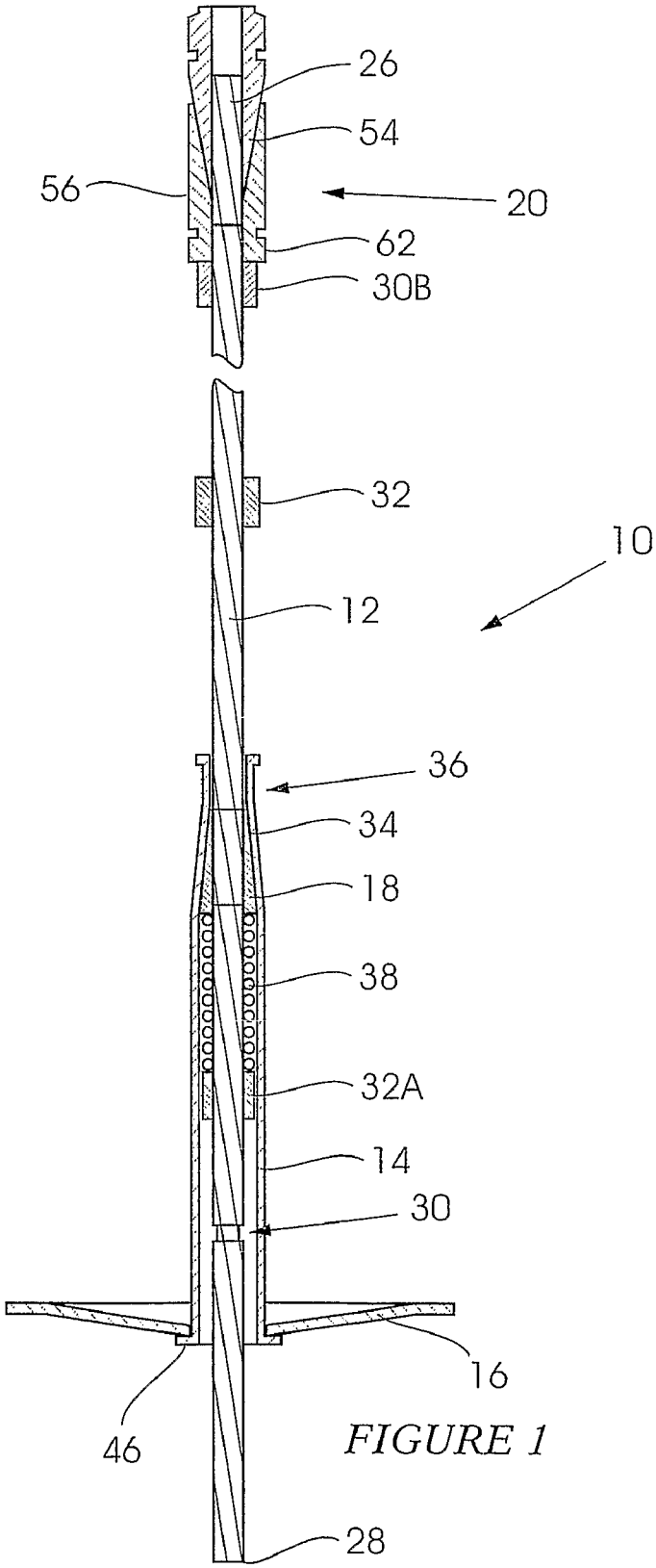
FIG. 1 is a side view, partly sectioned, of a rock anchor according to the invention.

FIG. 1 of the accompanying drawings is a side view, partly sectioned, of a rock anchor 10 according to the invention which includes an elongate length of cable 12, a tubular barrel 14, a domed face plate 16, a barrel wedge 18 and an impact-actuable expansion mechanism 20.

Figure 5:
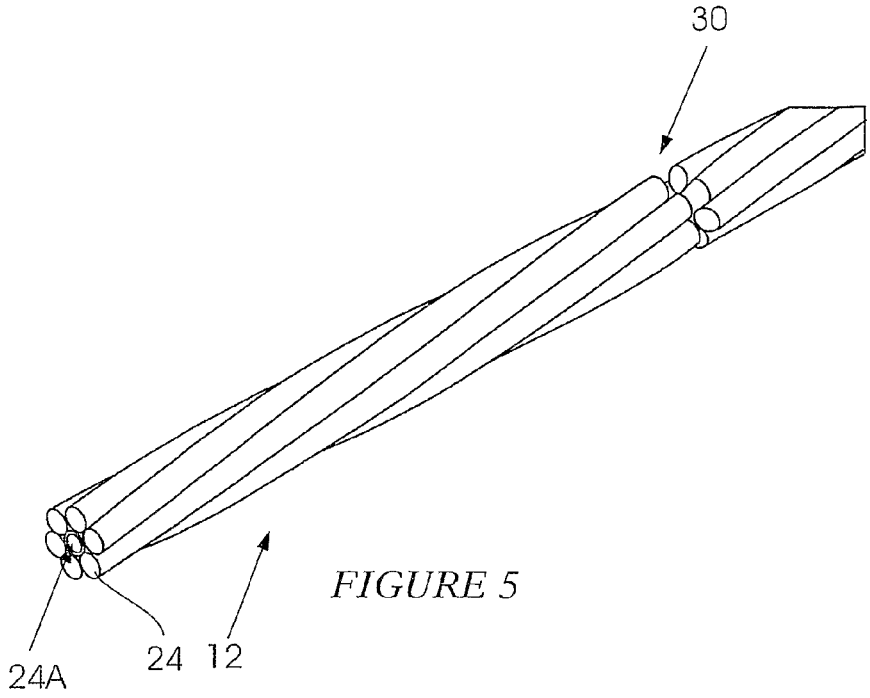
FIG. 5 is a view in perspective of part of a cable used in the rock anchor.

The cable 12 is flexible and is made from seven helically-extending wires 24, shown for example in FIG. 5. The cable is cut to a desired length according to installation requirements and has a first, inner end 26 and a second, outer end 28.

The cable has a weakened zone 30 near the second end 28. The zone 30 can be weakened in any appropriate way for example by removing some of the material of the individual wires 24 or by heating and then cooling some of the cable material near the zone 24 in order to alter the strength of the cable.

One or more sleeves 32 are crimped to the cable at chosen locations. These sleeves act as retention devices and ensure that the wires of the cable remain in a desired helical configuration.

The cable 12 extends through the tubular barrel 14. The barrel has an inner, tapered formation 34 near an end 36, and the barrel wedge 18 which has a conical shape, which is complementary to the tapered end 34, is positioned inside the tubular barrel adjacent the tapered end 32.

A sleeve 32A is crimped to the cable at a location which, once the anchor is assembled, is inside the barrel. A spring 38 acts between the crimped sleeve and an end of the barrel wedge in a direction which urges the barrel wedge towards the tapered formation 34.

Figure 3:
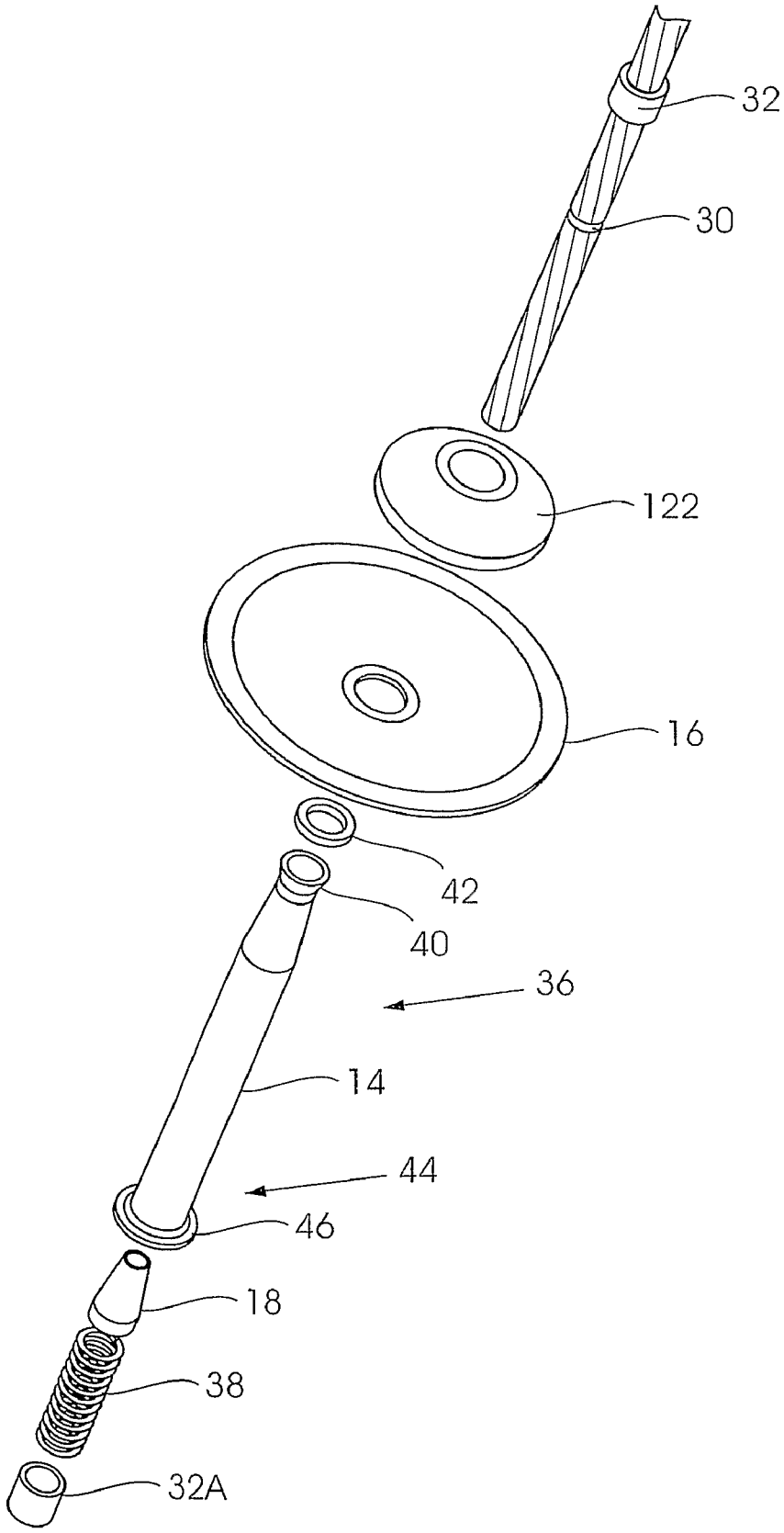
FIG. 3 is an exploded view in perspective of components at one end of the rock anchor.

As is clearly shown in FIG. 3, the tubular barrel, at the end 36, has an outer annular recess 40 and a seal 42 is engaged with the recess. An opposing end 44 of the barrel is formed with an outwardly extending rim 46 which is sized so that the domed washer 16, which can slide along the length of the barrel 14, is engaged with the rim as is shown in FIG. 1.

Figure 8:
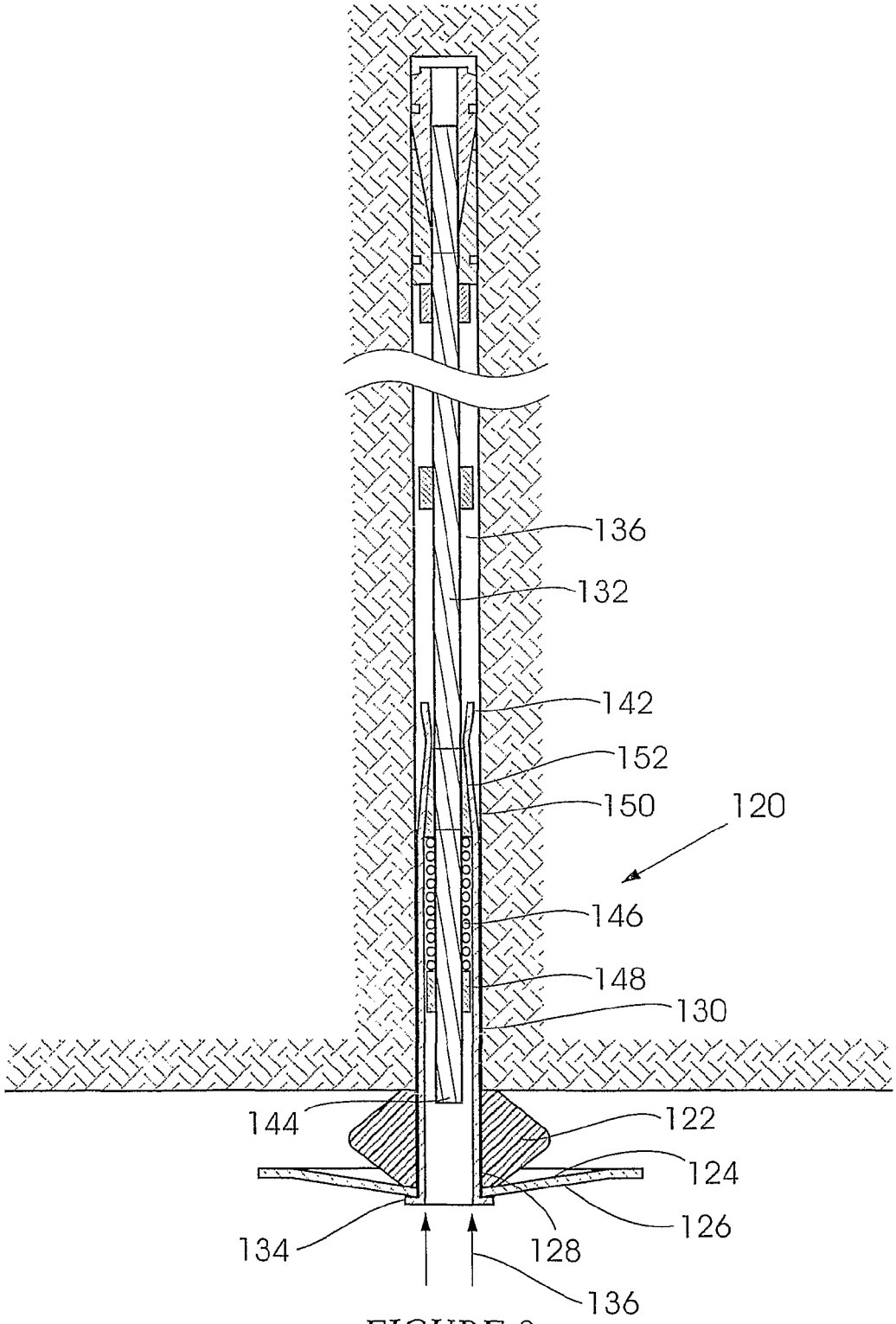
FIGS. 8 and 9 show a variation of the invention in different modes of use.
Figure 9:
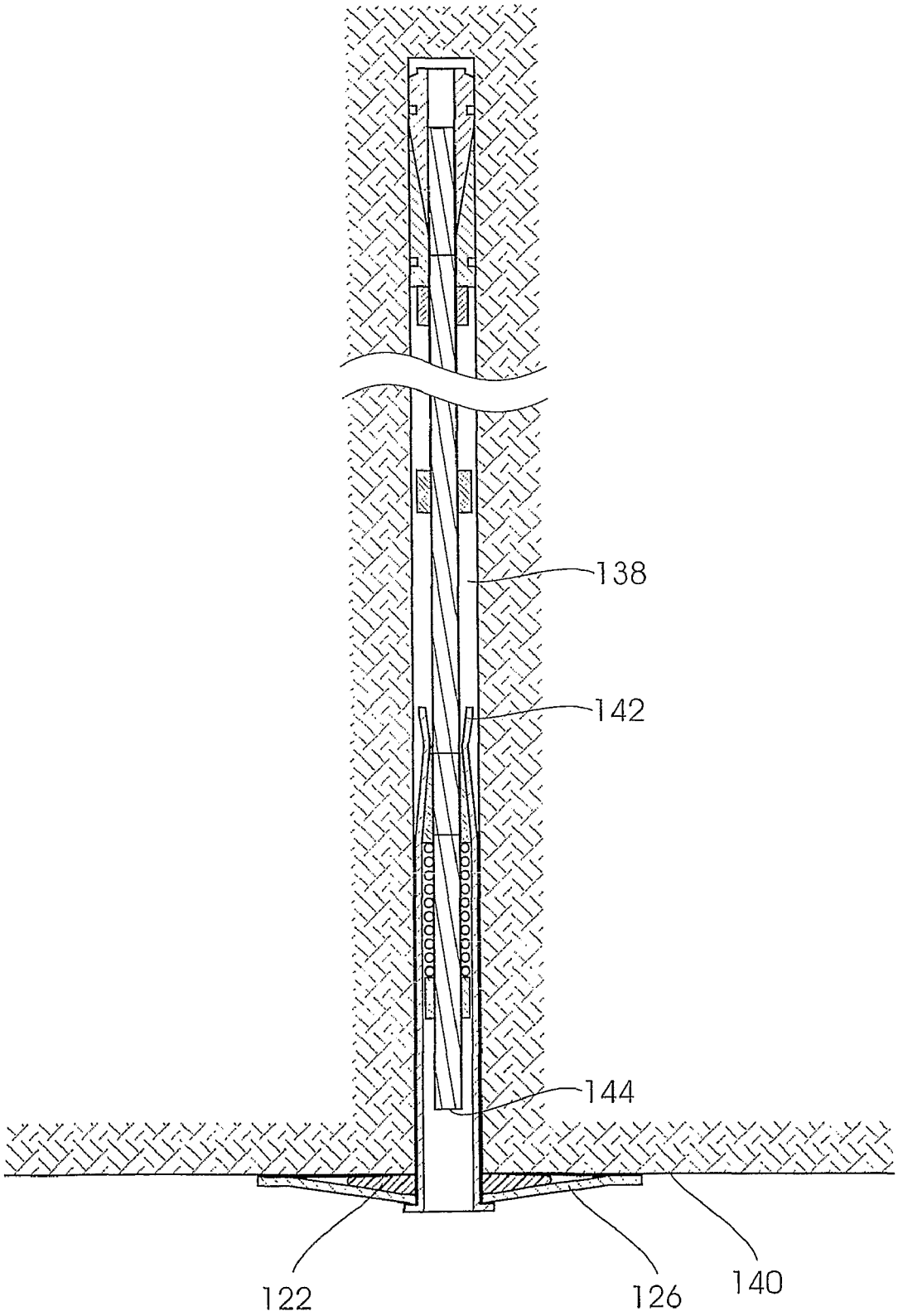

FIG. 3 shows a rubber block 122 which is further described herein with reference to FIGS. 8 and 9.

Figure 4:
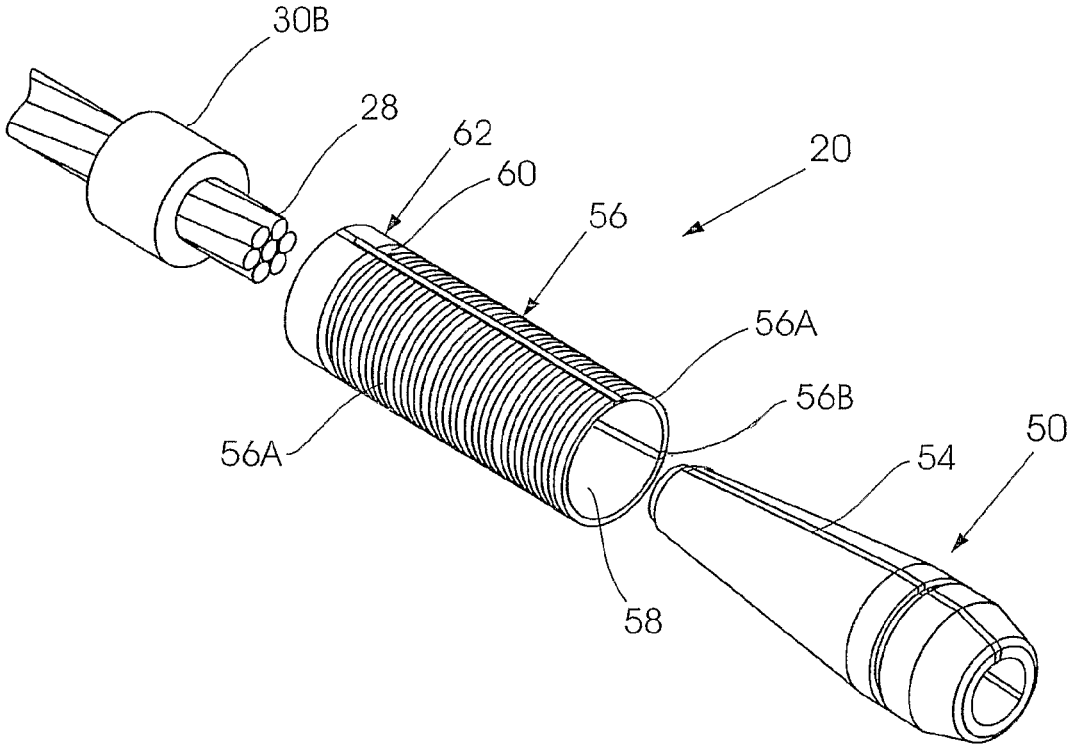
FIG. 4 is an exploded perspective view of components at an opposing end of the rock anchor.

The impact-actuable mechanism 20 is shown in an exploded configuration in FIG. 4 and includes a press-on impact sleeve 50 which is engaged with the first end 26 of the cable. The sleeve has an outer surface in the form of a conical wedge 54.

An expansion shell arrangement 56, which has an inner surface 58 of complementary taper to the wedge 54, is engaged with the wedge. The expansion shell arrangement is formed by a number of leaves 56A which are held in a tubular form around the wedge by means of a circular spring or similar device (not shown) which is located in an annular slot 60 defined by formations in bases 62 of the leaves.

A sleeve 30B which is crimped on the cable abuts one side of the bases 62.

Figure 2:
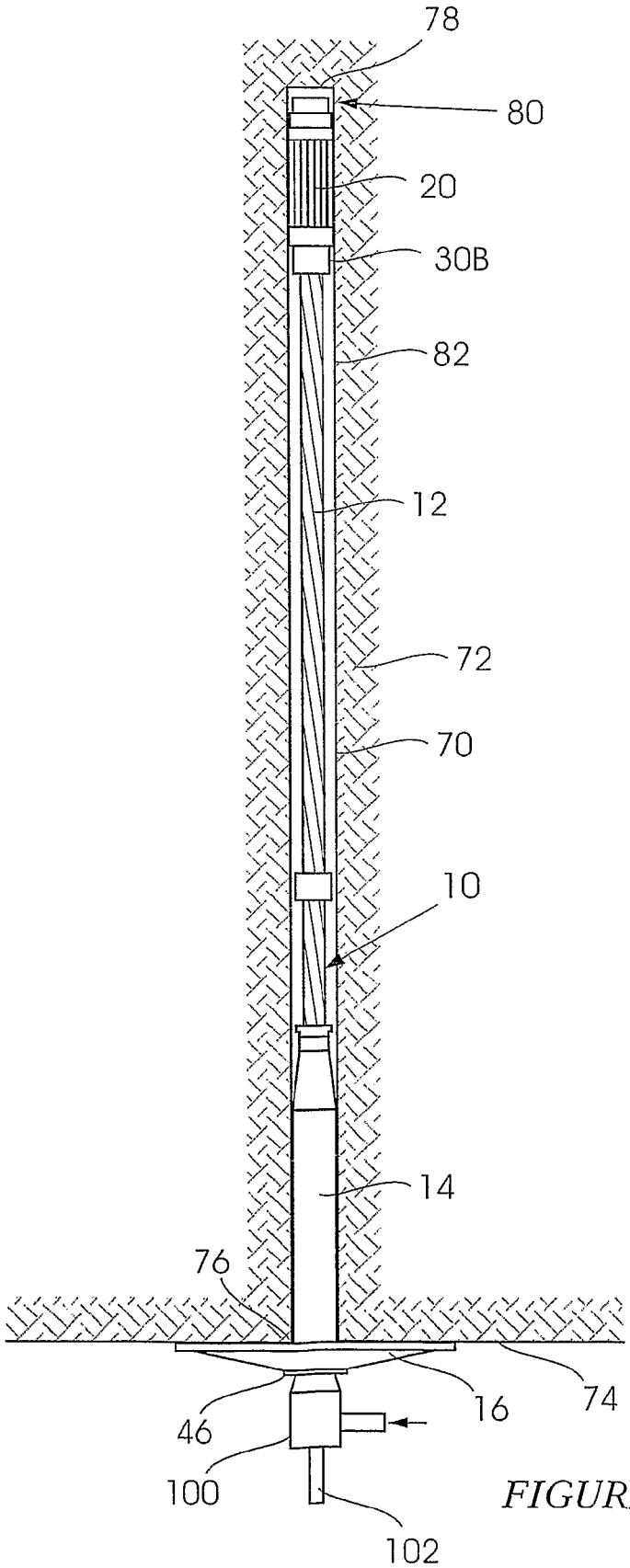
FIG. 2 shows the rock anchor of FIG. 1 in an installed configuration.

FIG. 2 shows the anchor 10 engaged with a hole 70 formed in a body of rock 72 from a rock face 74. Typically the hole is drilled from a narrow stope in an underground excavation. The stope may have a height of about one meter and, for example, the hole may have a depth, from a mouth 76 at the face 74 to a bottom 78 of the hole, of about two meters. The cable 12 has a length which matches the hole depth.

The cable 12 is sufficiently flexible and can be bent, while in the stope, so that the impact mechanism 20 can be inserted into the hole. As the cable is pushed further into the hole the cable is straightened.

The impact mechanism 20 must be impacted against the bottom 78 of the hole to set the mechanism. This is achieved by urging the cable deeper into the hole, either manually or by using a suitable tool, so that a leading end 80 of the conical wedge impacts against the hole bottom. The sleeve 30B then tends to drive the expansion shell towards the end 80 and the shell is expanded into light frictional contact with a wall 82 of the hole.

Figure 7:
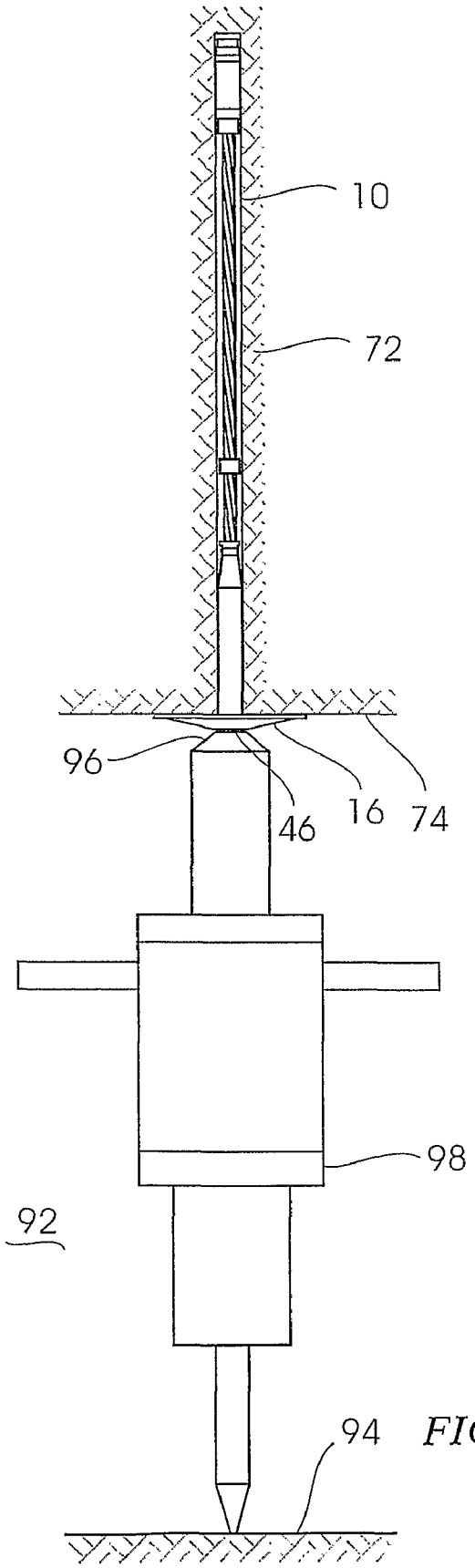
FIG. 7 shows how the anchor, illustrated in the installed configuration in FIG. 2, is prestressed.

FIG. 7 illustrates the use of a jack 90 to set the anchor. The jack is located in an excavation 92, and rests on a foot wall 94 which opposes the rock face 74. The second end 28 of the cable which protrudes from the mouth 76 is inserted into a barrel, in the jack, which automatically grips the cable. An end 96 of the jack acts against the rim 46 and, possibly, an adjacent portion of the face plate 16. The jack, which reacts against the rim 46, is actuated to tension the cable 12. The cable is thereby elongated slightly and, at the same time, the barrel 14 is urged slightly deeper into the hole. At a predetermined tensile force in the cable the zone 30, which is of reduced strength, fractures and the jack 90 is thereby disengaged from the cable length inside the hole. When the cable breaks the tensioned position inside the hole tends to contract and the sleeve 32A then acts on the spring 38 which in turn urges the barrel wedge 18 into frictional engagement with the inner tapered formation 34 at the end 36. During this process the cable at the first end 26 is gripped to an increasing extent by the wedge 54 and is thus frictionally and mechanically locked to the hole near the bottom 78. The cable is thereby frictionally locked to the tubular barrel, and via the mechanism 20 to the wall of the hole, near the bottom 78, in a tensioned state.

Figure 6:
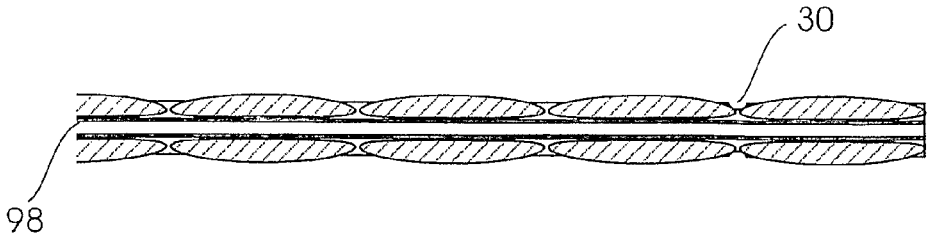
FIG. 6 is a side view in cross-section of the cable of FIG. 5.

Alternatively or additionally the anchor can be grouted in position. A central wire 24A of the seven-wire cable is removed and replaced with a flexible hollow tube 98—see FIGS. 5 and 6. The tube is used for evacuating air from the bottom of the hole, during post-grouting. A grout mixture of any appropriate kind is injected into the mouth 76 of the hole 70 through the tubular face plate and barrel assembly via a specially designed tool 100 which is connected to an interior of the barrel 14 at the rim 46—see FIG. 2. The grout may be cementitious or resin or of any other suitable form. The grout fills the hole around the cable and air, inside the hole, can escape from the bottom of the hole via slots 56B formed between adjacent leaves 56A in the expansion shell. The air then flows through the tube 98 from an inner end to an outer end 102 which extends through the tool 100. The seal 42 prevents the grout from escaping through an annular gap between the barrel and the wall of the hole.

It is not essential to replace the inner wire with the flexible tube. Once the inner wire has been removed the crimping sleeves 32 hold the seven-wire cable in its original shape. An open circular channel is then left inside the cable. When the cable is tensioned, using a jack of the kind shown in FIG. 7, the six remaining wires press tightly against each other and provide an effective seal around the space previously occupied by the inner wire 24A.

The face plate and the tubular barrel 14 may be integrally fabricated. Preferably the face plate is domed so that it deforms towards the rock face during preloading. This provides a visible indication of the preloading of the cable.

As the cable is flexible the anchor can easily be installed in a shallow stope without compromising the length of the anchor. The preloading of the cable provides immediate ground support for the rock strata and post-grouting provides full column reinforcement over the length of the anchor. In narrow stopes only the face plate is exposed. The face plate does not present rough edges or troublesome projections and thus does not present an obstacle to the movement of men or machinery in the stope.

FIG. 8 illustrates a rock anchor 120 according to the invention which is substantially similar to what has been described hereinbefore but which, additionally, has a biasing component 122 engaged with the tubular barrel and bearing against an inner face 124 of a load distributing face plate or washer 126. FIG. 9 shows the rock anchor 100 in an installed configuration.

The biasing component is made from a solid block of rubber of appropriate shore hardness and dimensions. A centrally positioned passage 128 extends through the block of rubber. The passage is dimensioned so that the barrel 130 can pass with a light friction fit through the passage.

Although the cable 132 can include a weakened zone at which the cable will snap when tensioned to a predetermined extent this is not essential. When the rock anchor is used a jack, not shown, is used to apply a compressive force to a rim 134 of the barrel, as is indicated by arrows 136, which tends to drive the barrel deeper into a hole 138 in the rock face see FIG. 9). As the magnitude of the force increases the biasing component 122 is compressed to a greater extent and ultimately the inner surface of the washer bears against the rock face 140 as is shown in FIG. 9. During this process the cable can advance through the upper end 142 of the tubular barrel and an end 144 of the cable which is inside the tubular barrel moves towards the rim 134.

If the force 136 is released then the biasing component 122 immediately starts expanding and there is a tendency for the load-distributing washer to move away from the rock face. When this occurs a spring 146 which constantly acts between stop structure 148 and a wedge 150 causes the wedge to be driven into the complementary formation 152 and, in the process, the wedge is locked to the tubular barrel and is locked to the cable as well. The cable is thus mechanically installed although, as noted, a grout can now be injected into the hole and air can, as before, escape through a hollow interior of the cable.

Figure 10:
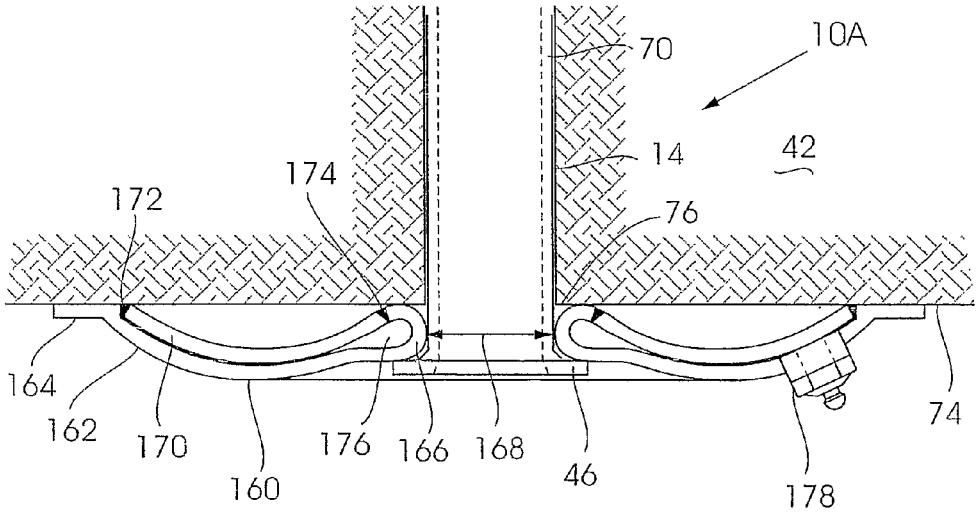
FIG. 10 shows another possible modification.

FIG. 10 illustrates another possible modification which can be used to pre-stress the rock anchor at the time of installation. Only a portion of the rock anchor is shown—this is adjacent a mouth 76 of a hole 70 which is formed in a body of rock 72 from a rock face 74. The tubular barrel 14 projects slightly from the hole 70 and, as before, has an outwardly extending rim 46 at one end.

A prestressing component 160 is engaged with the tubular barrel 14, abutting the rim 46 and the rock face 74.

The prestressing component 160 is formed from a first annular section 162 which has a flat outermost rim 164 which bears against the rock face, and an inner part 166 which is folded over to define a central aperture 168 through which the tubular barrel 14 can fit with a small tolerance. A curved surface of the part 166 abuts an outer surface of the tubular barrel and an adjacent surface of the rim 46. A second annular section 170 is welded at its outer and inner peripheries 172 and 174 respectively to the annular section 162. An enclosed volume 176 is thereby formed between opposing surfaces of the two annular sections. A one-way filler valve 178 is fixed to the annular section 162 and allows for the introduction of water under pressure from a suitable source, not shown, into the volume 176.

The rock anchor in FIG. 10 is, generally speaking, installed in the manner which has been described but when it becomes necessary to pre-stress the anchor use is not made of any of the aforementioned techniques. Instead the volume 176 is inflated and, in the process, the expanding prestressing component acts between the rim 46 and the rock face 74 and tends to pull the barrel 14 from the hole 70. The cable inside the hole 70 is thereby tensioned.

The prestressing component can be constructed in different shapes and sizes and can be reinforced, as appropriate, for example by adding ribs or other strengthening formations to one or both of the annular sections.

The invention claimed is:

1. A rock anchor which includes an elongate, flexible element with first and second ends, an anchor expansion mechanism at the first end, a tubular barrel into which the second end extends, and a locking arrangement inside the barrel which permits movement of the element in a first direction in the barrel and which locks the element to the barrel when the element moves in a second direction, opposing the first direction, in the barrel, characterized in that the tubular barrel in use, is located in a borehole in a rock, and has a first, inner mouth, a second, outer mouth and a passage between the mouths, a load-distributing face plate, with an inner side and an outer side, is engaged with the mouth of the tubular barrel, the locking arrangement includes a wedge device, inside the passage, which is engageable with a surface of the passage, at the inner mouth, of complementary taper to the wedge device, and through which the elongate element extends, and in that a biasing member acts between the element and the wedge device and urges the wedge device towards the surface of complementary taper.

2. A rock anchor according to claim 1 characterized in that the elongate, flexible member includes a weakened zone between the second, outer mouth of the tubular barrel and the biasing member.

3. A rock anchor according to claim 1 characterized in that the expansion mechanism includes an impact sleeve, with an outer wedge surface, and a passage into which the first end of the elongate element extends, and a shell arrangement which, at least partly, surrounds the wedge surface.

4. A rock anchor according to claim 1 characterized in that the expansion mechanism includes a wedge component which has a leading end and a trailing end and which extends around the first end of the elongate element, the leading end of the wedge component extending beyond the first end of the elongate element and the wedge component being of reducing cross section towards the trailing end, a shell arrangement which has an inner cavity of complementary shape to the wedge component which is located at least partly within the inner cavity, the shell arrangement having a base which surrounds the elongate element, and stop structure on the elongate element member located so that when the elongate element is moved in an axial direction, to cause the leading end of the wedge component to strike a reaction surface, the wedge component is driven into the inner cavity thereby to expand the shell arrangement.

5. A rock anchor according to claim 1 characterized in that the locking arrangement includes stop structure on the elongate element near the second end, the biasing member acts between the stop structure and the wedge device and tends to displace the wedge device away from the stop structure, and in that the stop structure and the wedge device are positioned inside the barrel and the second end of the elongate element is located within, and not protruding from, the tubular barrel.

6. A rock anchor according to claim 1 characterized in that the elongate flexible element is an elongate cable which is formed from a plurality of helically wound wires which extend around a longitudinally extending hollow channel.

7. A rock anchor according to claim 1 characterized in that it includes a mechanism which is actuable to exert force on the inner side of the face plate.

8. A method of reinforcing a rock which includes the steps of forming a hole into the rock from a rock face, placing an elongate, flexible element in the hole, and urging a first end of the elongate element towards a bottom of the hole thereby to actuate an anchor expansion mechanism which is engaged with the first end, and which is characterized by the steps of inserting a second end of the elongate element into a tubular barrel which is engaged with a face plate, positioning the face plate against the rock face, applying a tensile force to the elongate element by exerting an expansion force between a portion of the elongate element, which extends from the hole and the tubular barrel, and the rock face, providing a weakened zone in the elongate element within the tubular barrel, near the rock face, so that the weakened zone breaks when the tensile force is greater than a predetermined value and, upon breakage, actuating a locking arrangement inside the tubular barrel to lock the elongate element to the tubular barrel and to the face plate, with an end of the element inside the barrel.

9. A method according to claim 8 characterized in that, after actuation of the locking arrangement, a fluent, settable material is injected into the hole, around the elongate element, and air inside the hole is allowed to escape to atmosphere through a longitudinally extending hollow core in the elongate member.

* * * * *